United States Patent [19]

Cook et al.

[11] 4,183,983

[45] Jan. 15, 1980

[54] METHOD FOR REDUCING METAL OXIDE FORMATION ON A CONTINUOUS METAL SHEET IN THE HOT DIP COATING THEREOF

[75] Inventors: Eugene A. Cook, Lansdale; Chad F. Gottschlich, Philadelphia, both of Pa.

[73] Assignee: Selas Corporation of America, Dresher, Pa.

[21] Appl. No.: 934,627

[22] Filed: Aug. 17, 1978

[51] Int. Cl.[2] ..... C23C 1/02

[52] U.S. Cl. ..... 427/321; 427/433; 118/65; 118/67; 118/69

[58] Field of Search ..... 427/319, 320, 321, 329, 427/433; 118/65, 67; 148/156

[56] References Cited

U.S. PATENT DOCUMENTS

| | | | |
|---|---|---|---|
| Re. 28,168 | 9/1974 | Cope et al. | 148/20.3 X |
| 3,010,844 | 11/1961 | Klein et al. | 427/321 X |
| 3,320,085 | 5/1967 | Turner | 427/321 |
| 3,827,854 | 8/1974 | Gildersleeve | 432/19 |
| 4,082,868 | 4/1978 | Schnedler et al. | 427/329 |
| 4,103,644 | 8/1978 | Michels | 118/67 X |

OTHER PUBLICATIONS

Gibson et al., Zincgrip OS Armco's One-Side Galvanized Steel, The Product and The Process, The Galvanizers Committee Meeting, Birmingham, Alabama, Apr. 26, 1978, 12 pp.

*Primary Examiner*—Ralph S. Kendall
*Attorney, Agent, or Firm*—Miller & Prestia

[57] ABSTRACT

Sealing means for preventing metal vapor, and in particular zinc vapor, evolution from the surface of a bath into a furnace is provided at the exit end of the heat processing industrial furnace through which a continuous metal sheet is advanced. Upon exiting the furnace the metal sheet is dipped into a bath for hot dip coating thereof. At the zone of the industrial furnace from which the continuous metal sheet exits the furnace and advances into the coating bath, there is provided therein an atmosphere having a low dew point and a relatively high hydrogen content to thereby reduce the oxidation of the metal vapor which may have migrated into the furnace. Furthermore, sealing means are provided between zones of the furnace to retain the integrity of this atmosphere, and thus isolating zones having different atmosphere compositions.

15 Claims, 3 Drawing Figures

METHOD FOR REDUCING METAL OXIDE FORMATION ON A CONTINUOUS METAL SHEET IN THE HOT DIP COATING THEREOF

BACKGROUND OF THE INVENTION

The present invention relates to the hot dip coating of a continuous metal sheet, and more specifically to a method for preventing the deposition of a metal oxide on such a sheet.

In certain continuous processes in which hot metal sheets are coated by dipping in a molten metal bath, of a different metal, problems can arise because of the migration of the other metal as a vapor migrating into the furnace in which the metal strip is heated. Both the temperature and the atmosphere in the furnace must be controlled in order to prevent deposition of the metal vapor as an oxide on the sheet. Such oxidized deposits can produce imperfections in the coating of the final product.

Galvanizing of steel sheets is a particular type of hot dip coating and the resulting steel sheet has found many useful applications because of its resistance to corrosion. The method of hot dip coating is by far the most widely used method of producing galvanized steel sheets. In particular, the problem which has plagued those in the galvanizing industry is the migration of zinc vapor from the zinc coating bath into the furnace which results in the accumulation of a zinc oxide dust throughout the furnace. If this zinc oxide dust is present on the continuous steel sheet prior to its being dipped in the zinc bath, an acceptable galvanizing coating cannot be deposited onto the sheet. This problem has required those in the galvanizing industry to periodically shut down the furnace and clean out the zinc oxide dust when coating defects have reached an intolerable level. Such a shutdown is time consuming and costly.

It is therefore an object of the present invention to reduce the migration of metal vapor from the bath, i.e., the hot dip pot surface, into the furnace.

Another object of this invention is to insure that the furnace atmosphere is not oxidizing to the metal vapor.

SUMMARY OF THE INVENTION

In the method of the present invention metal oxide deposition is reduced on a continuous metal sheet which is being hot dip coated. The sheet advances through an industrial furnace having a snout which extends from the exit end of the furnace into a hot dip coating bath. A cooling zone extends to the snout or exit end of the furnace, and is for the purpose of lowering the sheet temperature to a predetermined coating temperature. In the practice of the present invention sealing means are provided in the exit end of the furnace, i.e. between the coating bath and the cooling zone, for substantial reduction of metal vapor which migrates from the surface of the bath to the cooling zone of the furnace. Further, the method of the present invention provides for a low dew point and high hydrogen atmosphere in the cooling zone thereby substantially reducing the oxidation of the metal vapor which migrates into the furnace.

DETAILED DESCRIPTION OF THE INVENTION

Figure 1:
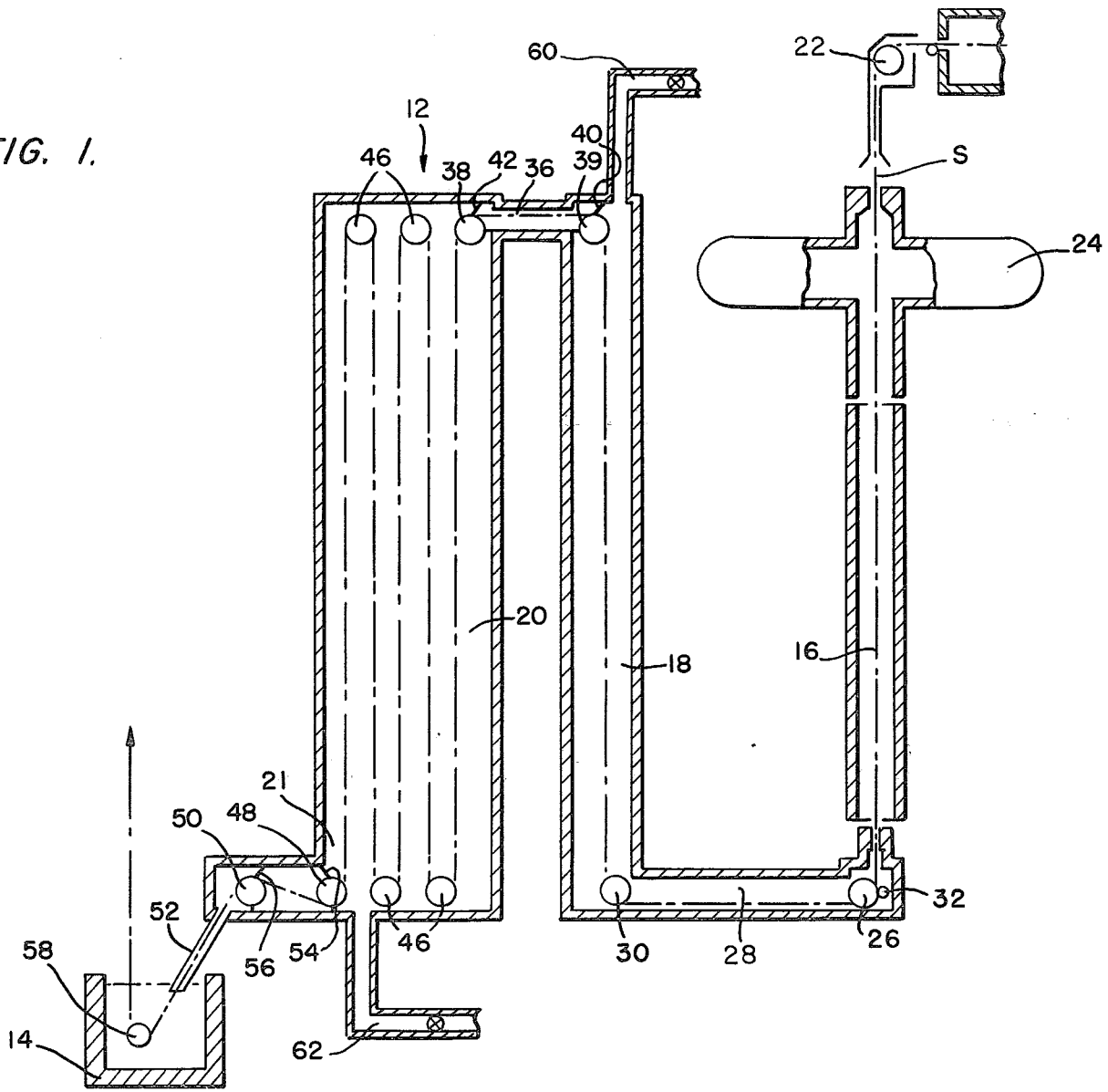
FIG. 1 is a cross-section elevational view of an industrial furnace and an associated hot dip coating bath utilized in the method of the present invention.

Referring to FIG. 1, for the purpose of describing the method of the present invention an industrial furnace designated as 12 is shown in association with a hot dip coating bath designated as 14. Furthermore, for the purpose of describing the method of the present invention, the method is set forth in relation to the galvanizing of a continuous metal sheet S, wherein the hot dip bath 14 is a zinc coating bath. It is assumed that the metal sheet S is of steel.

The industrial furnace 12 typically comprises three zones, which are the direct fired zone 16, the radiant tube zone 18 and the cooling zone 20 which extends to the exit end 21 of the furnace 12.

The continuous steel sheet S passes over a guide roll 22 to travel downwardly in a vertical path entering the direct fired zone 16 of the furnace 12. The direct fired zone 16 may be of a type shown in the U.S. Pat. No. 2,869,846 to Bloom or the U.S. Pat. No. 3,320,085 to Turner for example. The direct fired zone 16 is provided with radiant cup-type burners (not shown) which face the sheet and fire directly into the furnace chamber. Direct fired zone 16 heats the sheet to a high temperature and maintains the sheet at an appropriate processing temperature. The fuel-air ratio in zone 16 is further controlled to provide the necessary reducing character of the gases (products of combustion) for effecting proper heating and final strip-cleanup. The fuel-air ratio of the furnace is further regulated to provide a slight excess of fuel so that there is no free oxygen in the furnace atmosphere, and so that there are about 3 percent to 6 percent combustibles in the form of carbon monoxide and hydrogen. Combustion products rise in the zone 16 and are exhausted through ducts 24 at the top of the zone 16.

Steel sheet S then passes over a guide roller 26, through a first throat 28, over another guide roller 30 and travels vertically in an upward direction into the radiant tube zone 18. Sealing means are in contact with the guide roll 26 to restrict the mixing of the atmosphere of the direct fired zone 16 and radiant tube zone 18. The sealing means 32 are of a conventional type and are either flap gates or rolls.

Conventional radiant tubes are provided in the walls of the zone 18 through which hot gases flow thereby heating the sheet S passing therethrough. The sheet S may or may not be heated to a temperature higher than that which was obtained by its passing through the direct fired zone 16. The temperature to which it is heated in zone 18 depends on the desired metallurgical properties of the end product, for example the sheet S may be tempered, untempered or annealed depending on the heat processing it is subjected to as it passes through furnace 12. Typically, the atmosphere in the radiant tube zone 18 comprises a low hydrogen concentration, approximately 6 percent or less, with the remainder of the atmosphere being an inert gas such as nitrogen. The atmosphere in the radiant tube zone 18 is pumped in by way of inlet 60.

The steel strip S then passes over guide roll 39, through a second throat 36 then over guide roll 38 and is directed in a downward direction into cooling zone 20. In contact with both guide rolls 39 and 38 are sealing means 40 and 42 respectively, which are also of a conventional type. The sealing means 40 and 42 substantially reduce the mixing of the atmospheres in the radiant tube zone 18 and in the cooling zone 20. While in the cooling zone the sheet S makes several vertical passes in an upward and downward direction passing over guide rolls designated as 46. In the cooling zone 20 are tubes such as those found in the radiant tube zone 18, however, air is passed through these tubes and heat from the sheet S radiates to the tubes, thereby cooling the sheet to a predetermined galvanizing temperature.

In the practice of the present invention the atmosphere of the cooling zone 20 comprises a high percentage of hydrogen, approximately 15 percent or more with the remainder of the atmosphere being an inert gas such as nitrogen. It is also necessary that the cooling zone atmosphere have a low dew point in order to produce a high ratio of hydrogen to water vapor. The reason for these requirements in practicing the present invention will become more apparent from the subsequent discussion. The atmosphere of the cooling zone 20 is pumped in by way of inlet 62.

Sheet S exits the furnace 12 by passing over rolls 48 and 50 and advances through a snout 52 whose end is immersed in the zinc coating bath 14. Sealing means 54 and 56 are respectively in contact with guide rolls 48 and 50, and like the other sealing means are of a conventional type. Once the sheet S is dipped in the zinc coating bath 14 it is zinc coated, i.e, galvanized, and passes over a guide roller 58 which guides the sheet S to other processing equipment not herein described. Metals in addition to zinc may be used in the coating bath 14, for example, a zinc-aluminum binary system may constitute the coating bath 14, where the zinc comprises about 25 atomic percent of the bath and the aluminum comprises about 75 atomic percent of the bath.

A purpose of the method of the present invention is to prevent zinc oxide deposition on the sheet S during its galvanizing processing. As is well understood by those skilled in the art, zinc vaporizes from the surface of the bath 14 as a function of the bath temperature. However, the amount of zinc evolved is accelerated as the bath temperature increases, as the bath area increases, and as the partial pressure gradient along the furnace path from the bath increases. Therefore, one means to minimize zinc evolution is by lowering the bath temperature. For example, present operating practice has been to have the bath 14 at a temperature of about 605° C. which corresponds to a vapor pressure of 12.5 mm Hg. However, for a 45/50 (by weight) zinc-aluminum binary bath the liquidus temperature is 585° C. which corresponds to a vapor pressure of 8.5 mm Hg. Thus, if the bath could be controlled at 585° C., zinc evolution could be reduced by approximately 32 percent. Furthermore, zinc evolution can be minimized by keeping the bath area as small as possible, as well as making the bath surface as quiescent as possible.

In addition to the foregoing means for minimizing the problem of zinc evolution, the present invention provides means for further reducing the migration of zinc into the furnace, primarily by the use of sealing means as previously described in combination with a furnace atmosphere, at least in the cooling zone, which prohibits the oxidation of zinc which migrates into the furnace.

Turning to the snout area of the furnace, zinc will of course evolve from the bath surface and the moving sheet S functions as a pump, pulling the atmosphere of the cooling zone 20 along with it. Thus the nonoxidizing atmosphere in the snout is provided by the pumping action of the sheet S advancing from the cooling zone into the snout. As is well understood, in order to maintain the system pressure since the moving strips acts as a pump, pulling along the atmosphere in one direction, a reverse atmosphere flow is set up which would therefore push the evolved zinc into the cooling zone 20 of the furnace 12. However, the sealing means 54 and 56 substantially seals the furnace and specifically the cooling zone 20. Since the total flow of the evolved zinc from the bath-snout area is a function of open flow area, it follows that a reduction of the open flow area as a result of the sealing means 54 and 56 will therefore reduce this reverse flow. With the snout diameter at the surface of the coating bath 14, having a cross-section of approximately 6 inches by 60 inches and further with a gap between the sealing means 54 and 56 and their respective guide roll being of an area of approximately 0.2 inch by 60 inches it has been calculated that the zinc leakage rate into the cooling zone 20 is about 0.12 pounds per hour of zinc versus a calculated rate of 2.5 pounds per hour where no sealing means are provided.

Figure 2:
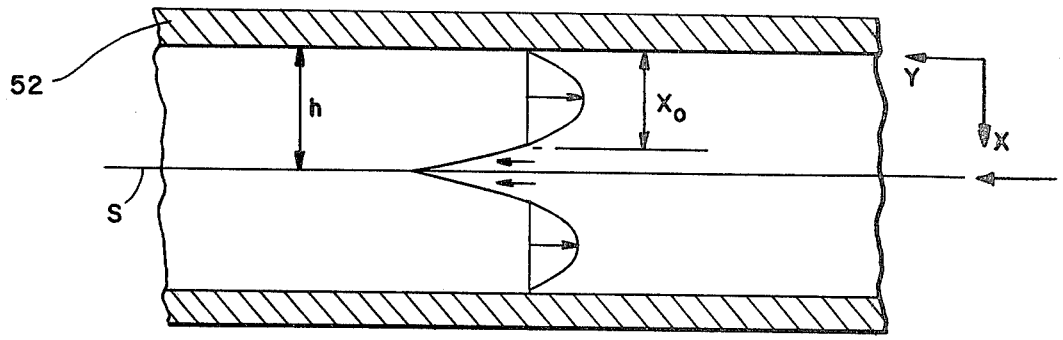
FIG. 2 is a cross-sectional view of a portion of the snout showing the associated circulating flow in the snout.

Calculation of the zinc leakage rate is subsequently described in more detail with reference to FIG. 2. The rate at which the atmosphere circulates in the snout 52 is subsequently calculated considering a small section of the snout, as shown in FIG. 2. Under the assumed operating conditions there is a laminar flow in the snout 52. The velocity profile is parabolic (neglecting end and edge effects). The equation for the velocity profile is:

$$V = V_S\,[3(x/h) - 2](x/h) \qquad (1)$$

WHERE "V" is the gas velocity, in FT/HR:

"$V_S$"=Strip velocity at about 27,000 FT/HR:

"X" is the distance from snout wall, in FT;

"h" is the wall to strip distance=0.25 FT;

"$X_o$" is the distance at which flow reversal occurs in FT, $X_o/h=2/3$.

The circulation rate is found by integrating, from $X_o$ to the sheet surface, the Equation:

$$Q_c = 2WV_s h \int_{\frac{2}{3}}^{1} (V/V_s)\,d(x/h) \qquad (2)$$

WHERE

"W" is the width of the snout which is 5.0 FT, and

"Q" is the circulation rate for the two sides of the strip in $FT^3/HR$.

From Equation (2) the circulation rate is found to be 10,000 $FT^3/HR$. For a typical snout length of 8 feet, with its volume at only 20 $FT^3$, it is apparent the sheet is an excellent mixing pump, and that the zinc vapor concentration should be uniform throughout the snout 52.

Assuming a 25% (atomic) zinc solution in aluminum, and further assuming that Raoult's law for ideal solutions holds, the vapor pressure of the zinc over the solution will be 3.1 mm Hg at 605° C., and 2.1 mm Hg at 585° C. The circulation rate of zinc vapor is therefore, $$W_{Zn} = MQ_c P_{Zn}/RT \qquad (3)$$

"$W_{Zn}$" is the zinc circulation rate in LBS/HR;

"$P_{Zn}$" is the zinc partial pressure in atmospheres;
"R" is the gas constant equal to 0.7302FT$^3$ ATMOS/-Mole/°R
"T" is the gas temperature at 1392° R; and
"M" is the molecular weight of zinc of 63.38.

The zinc circulation rate ($W_{Zn}$) at 585° C. and 605° C. is, respective, 1.7 and 2.5 LBS/HR. If there are no sealing means 54 and 56, the zinc vapor would be pumped into the cooling zone 20 at a rate slightly less since some zinc condenses on the snout 52 and sheet surfaces, (for a typical sheet temperature of 500° C.), and because of the mass transfer resistance at the gas-zinc pot interface. A worse case approximation is to assume the rate is not reduced. The zinc partial pressure will be fairly uniform in the snout 52 and at worst will be between 2.1 and 3.1 mm Hg. With the sealing means 54 and 56 there are two countercurrent, laminar streams of gas passing through each seal gap of the sealing means. It could be assumed that the flow profile in the seal gap is the same as in the snout. A more conservative assumption would be to assume that the flow reversal point is midway in the gap and that the flow velocity equals the strip velocity, than the circulation rate is:

$$(450 \times 60)\left(\frac{0.1}{12}\right)\left(\frac{60}{12}\right) = 1125 \text{ FT}^3/\text{HR}$$

From equation 3 the zinc vapor laden gas flows past the sealing means 56 at:

$$M(1125)\, P_{Zn}/RT = 0.20 \text{ LB Zn/HR}_{585C}$$
$$0.30 \text{ Lb Zn/HR}_{605C}$$

Sealing means 54 and 56 acting together with the fresh atmosphere gas supply upstream produce a zinc leakage rate of 0.08 to 0.12 LBS/HR and a zinc partial pressure of 0.37 to 0.54 mm Hg entering the cooling zone 20.

The corresponding zinc dew point is 447° to 462° C. insuring that the zinc will not condense in the gas, which is at 500° C., nor on the sheet, which is at or above 500° C., in the cooling zone 20. Instead it will condense on the cooling tube and perhaps on the chamber walls, but at a rate much slower than with no sealing means.

The maximum water vapor partial pressure permitted to insure no oxidation of zinc at or above 500° C. is found as follows:

Equilibrium constant $K_p = (P_{H2}/P_{H2O}\, P_{Zn}) = 2 \times 10^7$ ATMOS$^{-1}$
Thus, $P_{H2O} = (0.15 \times 760^2)/(0.54 \times 2 \times 10^7)$
$= 0.0080$mm Hg This corresponds to a water dew point of −76° F.

If a lower percentage of hydrogen, i.e., 15 percent or less, was used then a lower dew point would be required, however it is more practical to raise the hydrogen content than to lower the dew point substantially.

The calculation is conservative because an extreme form of the velocity profile was assumed. Also, the fact that zinc will be transferred between the two countercurrent streams flowing in the seal gaps was neglected. Thus, the actual zinc leakage should be less than calculated.

Furthermore, the atmosphere of the cooling zone along with its low dew point, insures that any zinc that does leak in will not oxidize nor will it condense out except on the cooling tubes and possibly some enclosure walls.

If no sealing means is used between the snout and the cooling zone, most of the greatly increased flow of zinc will condense on contact with the typically 500° C. gas in the cooling zone creating a potentially troublesome mist of zinc. In addition, the partial pressure of zinc vapor will rise to 1.4 mm Hg, which is the vapor pressure of zinc at 500° C.

The increase in zinc partial pressure requires that the partial pressure of water vapor be reduced to 0.0031 mm Hg (a dew point of −88° F.) to prevent zinc oxidation. Because of migration of water vapor into the cooling zone from the radiant tube zone, the low dew point is difficult to achieve.

Any oxygen or water vapor in the furnace may oxidize zinc which has migrated into the furnace. The furnace of course cannot be a perfect barrier against the ambient and some oxygen may leak into the furnace. Nevertheless, if we assume a total leakage area of one square inch with an internal furnace pressure of 0.25 inch, W.C., it has been calculated that the oxygen diffusion into the furnace is quite negligible. Furthermore, the atmosphere in the cooling zone 20 is maintained at a low dew point which means that the water vapor content in the cooling zone will be low.

It has been further found that the sealing means 40 and 42 provide for the retention of the low dew point required in the cooling zone 20, and further resists the degradation of the hydrogen content in the cooling zone 20, by reducing the net atmosphere flow and pumping action of the sheet S from the radiant tube zone 18 which is typically at a higher dew point and having a lower percentage of hydrogen, i.e. for example about 6 percent or less, than the cooling zone 20. The sealing means 32 at the exit of the direct fire zone 16 also provides each zone with substantial stabilization of its atmosphere conditions and assists in isolating the atmosphere of all the furnace zones.

Sealing means 40 and 42 perform another important function which is permitting a low flow of high hydrogen gas into the cooling zone 20 while allowing a high flow of low hydrogen gas into the radiant zone 18 thereby eliminating the potential of an explosion because of dangerously high hydrogen gas concentration reaching furance zones which operate normally with oxygen or could contain oxygen during abnormal operating conditions.

An example, of the operating conditions and the atmosphere parameters of the furnace 12 with and without sealing means are subsequently described to show that seals influence the dew point in each zone, i.e. if the seals are not in furnace 12 there would be a greater back-mixing of atmospheres between the zones as a result of the pumping effect of the sheet S.

The atmosphere in the direct fired zone 16 has a dew point of about 140° F. corresponding to a water partial pressure of 160 mm Hg. In the radiant tube zone 18 the atmosphere supplied by inlet 60 consists of 5 percent hydrogen and 95 percent nitrogen at a dew point of minus 40° F., at a gas flow of 12,000 SCFH, while the atmosphere supplied by inlet 62 to the cooling zone 20 comprises 15 percent hydrogen and 85 nitrogen at 500° C. with a gas flow rate of 1,000 SCFH and at a dew point of minus 90° F.

Determination of dew points in the furnace zones is subsequently described with reference to FIG. 3. Using $X_o/h$ calculated from laminar theory, but assuming a more conservative square flow profile instead of parabolic for the flow next to the sheet S the circulation rates through the first and second throats 28 and 36, with their respective sealing means are:

$$Q_{cThroat\ 2}=222\ FT^3/HR$$

$$Q_{cThroat\ 1}=23.4\ FT^3/HR$$

Figure 3:
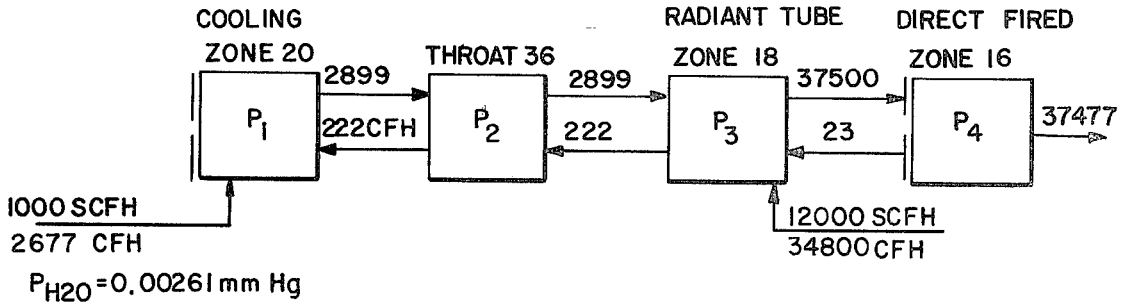
FIG. 3 is a flow diagram of the industrial furnace of FIG. 1.

To be more conservative we will use these values and idealize the system as shown in the flow diagram of FIG. 3.

The partial pressure of water vapor in the direct fired zone 16, $P_4$, will be about 160 mm Hg. A material balance around zone 20 and zone 18 gives:

$$2677(0.00261)+23.4(160)+34800(0.0966)=37500\ P_3$$

$$P_3=0.190\ \text{mm Hg};$$

While a material balance around zone 20 and throat 36 with sealing means 42 gives:

$$P_2=\frac{2677(0.00261)+222(0.190)}{2899}=0.0169\text{mm Hg.}$$

While a material balance around zone 20 and throat 36 with sealing means 42 gives:

$$P_1=\frac{2677(0.00261)+222(0.0169)}{2899}=0.00371\text{mm Hg.}$$

Therefore, the corresponding dew points are:

$$DP_1=-86.2°\ F.$$

$$DP_2=-65.9°\ F.$$

$$DP_3=-29°\ F.$$

The calculated dew points clearly indicate that the sealing means discussed are necessary to achieve the −76° F. moisture dew point required by the cooling zone to prevent gas phase oxidation of zinc vapor. Further, the sealing means provide a margin of safety, i.e., the oxidation equations demands a water vapor partial pressure of less than 0.0080 mm Hg (−76° F. dew point) while the seals provide a partial pressure of 0.0037 mm Hg (−86.2° F. dew point).

In the practice of the present invention sealing means are provided between the hot dip bath and the cooling zone and between the cooling zone and other furnace zones. The first seal reduces the migration of metal vapor into the cooling zone. The second seal insures the maintenance of high hydrogen, low water vapor atmosphere in the cooling zone. In combination, the seals insure that no metal oxide will form, except on the cooling tube surfaces and possibly some enclosure walls; and, further, that the rate of accumulation of metal oxide will be markedly reduced.

Therefore, the method of the present invention provides means for controlling the formation of metal oxide on the surface of continuous steel sheet prior to its being dipped into a hot dip coating bath for hot dip coating thereof.

Although this invention has been described with reference to a specific embodiment thereof it will be appreciated that other modifications of the embodiment may be made, including the substitution of equivalent components or method steps in substitution for those described. Furthermore, the invention comprehends the use of certain method steps independently of others, all of which may be made without departing from the spirit and scope of the invention as defined in the appended claims.

We claim:

1. A method for reducing metal oxide deposition on a metal sheet advancing through an industrial furnace in the hot dip coating of a continuous sheet, said furnace having an exit end with a snout extending therefrom and into a hot dip coating bath, a cooling zone adjacent to said exit end for lowering the sheet temperature to a predetermined coating temperature, and other zones in said furnace for the heat processing of a sheet, said sheet traveling from said cooling zone into said snout, comprising the steps of:

(a) sealing at said exit end for the substantial reduction of metal vapor migration from the surface of said bath into said cooling zone by sealing said exit end and by conducting atmosphere from said cooling zone into said snout by the action of sheet advancement from said cooling zone into said snout, which action pulls along cooling zone atmosphere into said snout; and (b) providing an atmosphere in said cooling zone which substantially reduces the oxidation of metal vapor which migrates into said furnace.

2. The method in accordance with claim 1, wherein said cooling zone atmosphere has a low dew point and a high percentage of hydrogen as compared to at least one other zone in said furnace.

3. The method in accordance with claim 2, wherein said furnace has a plurality of sequentially located zones for the heat processing of said metal sheet, wherein said cooling zone is one of said zones, and each of said zones having at least one neighboring zone, comprising the step of:

sealing between said cooling zone and said zone neighboring said cooling zone, and sealing between said other neighboring zones for substantially reducing the migration into said cooling zone of an atmosphere containing water vapor and a lower percentage of hydrogen than provided in said cooling zone atmosphere.

4. The method in accordance with claim 3, wherein said low percentage of hydrogen is about 6 percent or less.

5. The method in accordance with claim 2, wherein said furnace has a plurality of sequentially located zones for the heat processing of said metal sheet, wherein said cooling zone is one of said zones, and each of said zones having at least one neighboring zone, comprising the further step of:

sealing between said cooling zone and said zone neighboring said cooling zone, and sealing between said other neighboring zones for substantially reducing the back mixing into said cooling zone of a higher dew point atmosphere.

6. The method in accordance with claim 2, wherein said other furnace zones being a radiant tube zone and a direct fired heating zone, said furnace constructed so that said continuous sheet advances through said direct fired heating zone, then said radiant tube zone and then said cooling zone, comprising the further step of:

sealing between said cooling zone and said radiant tube zone for substantially reducing the migration into said cooling zone of an atmosphere from at least one of said other zones having more water vapor and a lower percentage of hydrogen than provided in said cooling zone.

7. The method in accordance with claim 6, comprising the further step of:

sealing between said radiant tube zone and said direct fired heating zone for further substantially reducing the migration into said cooling zone of an atmosphere having water vapor and a lower percentage of hydrogen.

8. The method in accordance with claim 2, wherein said other furnace zones being a radiant tube zone and a direct fired heating zone, said furnace constructed so that said continuous sheet advances through said direct fired heating zone, then said radiant tube zone and then said cooling zone, comprising the further step of:

sealing between said cooling zone and said radiant tube zone for substantially reducing the back mixing of a higher dew point atmosphere into said cooling zone from one of said other zones.

9. The method in accordance with claim 8, comprising the further step of:

sealing between said radiant tube zone and said direct fired heating zone for further substantially reducing the back mixing of a higher dew point atmosphere into said cooling zone.

10. The method in accordance with claim 2, wherein said cooling zone atmosphere comprises about 15 percent or more hydrogen.

11. The method in accordance with claim 2, wherein said cooling zone dew point being about minus 76° F. or less.

12. The method in accordance with claim 1, wherein said sealing is provided by flat gates.

13. The method in accordance with claim 1, wherein said sealing is provided by rolls.

14. The method in accordance with claim 1, wherein said hot dip coating process is galvanizing, and said hot dip bath having zinc, and said metal vapor is zinc.

15. The method in accordance with claim 1 comprising the further step of:

providing for the hot dip coating bath surface being quiescent.

* * * * *